US005513920A

United States Patent [19]

Whritenor et al.

[11] Patent Number: 5,513,920

[45] Date of Patent: May 7, 1996

[54] DYE DONOR WEB LOADING APPARATUS FOR A THERMAL PRINTER

[75] Inventors: James A. Whritenor, Mendon; Michael J. Ehmann, Rochester, both of N.Y.

[73] Assignee: Eastman Kodak Company, Rochester, N.Y.

[21] Appl. No.: 968,931

[22] Filed: Oct. 29, 1992

[51] Int. Cl.[6] ..... B65H 75/00

[52] U.S. Cl. ..... 400/246; 400/242; 242/607

[58] Field of Search ..... 400/120, 242, 400/243, 244, 245, 246, 250; 242/68, 68.1, 68.2, 68.4, 68.7, 68.5, 55.2, 607

[56] References Cited

U.S. PATENT DOCUMENTS

| | | | |
|---|---|---|---|
| 4,768,039 | 8/1988 | Akutagawa et al. | 346/76 PH |
| 4,978,240 | 12/1990 | Katsuno | 400/246 X |
| 5,230,574 | 7/1993 | Namekawa | 400/246 X |

FOREIGN PATENT DOCUMENTS

| | | | |
|---|---|---|---|
| 0435108 | 7/1991 | European Pat. Off. . | |
| 0475404 | 3/1992 | European Pat. Off. . | |
| 0042082 | 3/1985 | Japan | 400/243 |
| 0174674 | 9/1985 | Japan | 400/246 |
| 03005178 | 1/1991 | Japan . | |
| 03169578 | 7/1991 | Japan . | |
| 3230984 | 10/1991 | Japan | 400/246 |
| 4049084 | 2/1992 | Japan | 400/242 |

*Primary Examiner*—Christopher A. Bennett
*Attorney, Agent, or Firm*—Milton S. Sales

[57] ABSTRACT

A thermal printer has a dye donor supply spool with a body and first and second end portions extending from the body. First and second receptacles are positioned for matingly receiving the first and second end portions of the dye donor supply spool. The supply spool is correctly loaded only when the first and second end portions of the supply spool matingly engage the first and second receptacles, respectively. A mechanical stop prevents incorrect end for end loading of a supply spool that has an off center web wound thereon by engaging the web and preventing the end of the spool from engaging the receptacle.

3 Claims, 7 Drawing Sheets

DYE DONOR WEB LOADING APPARATUS FOR A THERMAL PRINTER

TECHNICAL FIELD

This invention relates generally to thermal printers, and, more particularly, to an apparatus to ensure correct loading of a dye donor web wound upon a spool in a thermal printer.

BACKGROUND OF THE INVENTION

It is desirable to have a thermal printer in which it is easy to accurately load the dye donor ribbon. It is desirable to make the printer as easy to use as practical while being cost effective in the manufacturing process. Some thermal printers have a disposable dye donor cartridge mounted in the printer to hold the dye donor supply and take-up spools and offer convenience of use because it is relatively easy to insert and remove the cartridge. This is especially true in instances where the cartridge is keyed to be insertable with only one orientation. While cartridges offer convenience, they are expensive and discarded after one use. Unfortunately, attempts to make cartridges reusable to conserve resources have failed because it is difficult to rewind dye donor in a cartridge at the point of use.

To eliminate the problems associated with cartridges, some printers have configurations that mount the donor spools in the print engine without the benefit of a cartridge, while other printers mount the spool in the printer door, again without cartridges. Where spools are used without cartridges, there are also problems that arise. Space is always a consideration and there is not always sufficient room for all hands to manipulate the spools, regardless of whether the spools are full or empty. A spool can be mispositioned on the drive elements and therefore completely inoperative, or may cause annoying printing errors.

Failure to correctly orient the supply and take-up spools creates a situation wherein the printer will not function properly, if at all. Correct loading requires having the supply and take-up spools in their proper places as well as having the donor supply spool oriented correctly end for end. Incorrect end for end orientation causes the web to traverse an incorrect path through the printer, if it traverses a path at all. With an improperly loaded dye donor web, it is very difficult, if not impossible, to achieve exact color registration and produce a quality image with undesirable artifacts.

While a careful and skillful operator can study the spools and the spool receiving mechanism and achieve correct insertion of the supply and take-up spools, doing so is burdensome, even for a skilled operator. An operator does not want to read lengthy or complicated instructions or observe burdensome or annoying practices just to ready a machine for use, and typically has more than one machine to operate and desires convenience so that having to refer to manuals or read instructions is quite a burden. An operator wants to simply drop the donor web into place, especially where doing so is an occasional and unscheduled chore. Accordingly, it will be appreciated that it would be highly desirable to have an apparatus and method for simply and correctly loading a donor web wound upon a spool into the printer which prevents operation of the printer when incorrectly loaded.

SUMMARY OF THE INVENTION

The present invention is directed to overcoming one or more of the problems set forth above. According to one aspect of the present invention, a thermal printer has first and second receptacles for receiving a dye donor supply spool having first and second end portions for engaging the receptacles. End for end swapping of the supply spool having an off center dye donor web is prevented by a mechanical stop that engages an incorrectly inserted spool.

Space is normally in short supply in a thermal printer so that the door will not close properly when the donor supply spool is not correctly seated. Thus, when the dye donor spool is not correctly inserted, dye donor is conserved by the unseated spool breaking the door-base interface which breaks electrical circuits to prevent operation of the printer.

According to another aspect of the invention, a thermal printer comprises a dye donor supply spool having first and second end portions. A first receptacle is positioned for matingly receiving the first end portion of the dye donor supply spool, and a second receptacle is positioned for matingly receiving the second end portion of the dye donor supply spool. The supply spool is correctly loaded only when the first and second end portions of the supply spool matingly engage the first and second receptacles, respectively. Third and fourth receptacles are positioned for matingly receiving the first and second end portions of a dye donor take-up spool. Means are provided for preventing incorrect loading of the supply spool.

The receptacles have tapered slots for receiving and guiding the donor spool, and may be color coded to prevent improper insertion of the dye donor spool. Also, the spools may be of different lengths, or the web may be centered on one spool and off center on the other spool. The members snap onto the spool when the spool is properly inserted.

According to another aspect of the invention, a thermal printer, comprises a supply spool, a dye donor web wound off center on the supply spool, and means for preventing incorrect end for end loading of the supply spool. The means for preventing incorrect end for end loading of the supply spool includes a mechanical stop member facing one end of the supply spool to intercept the dye donor web when the ends of the spool are swapped.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
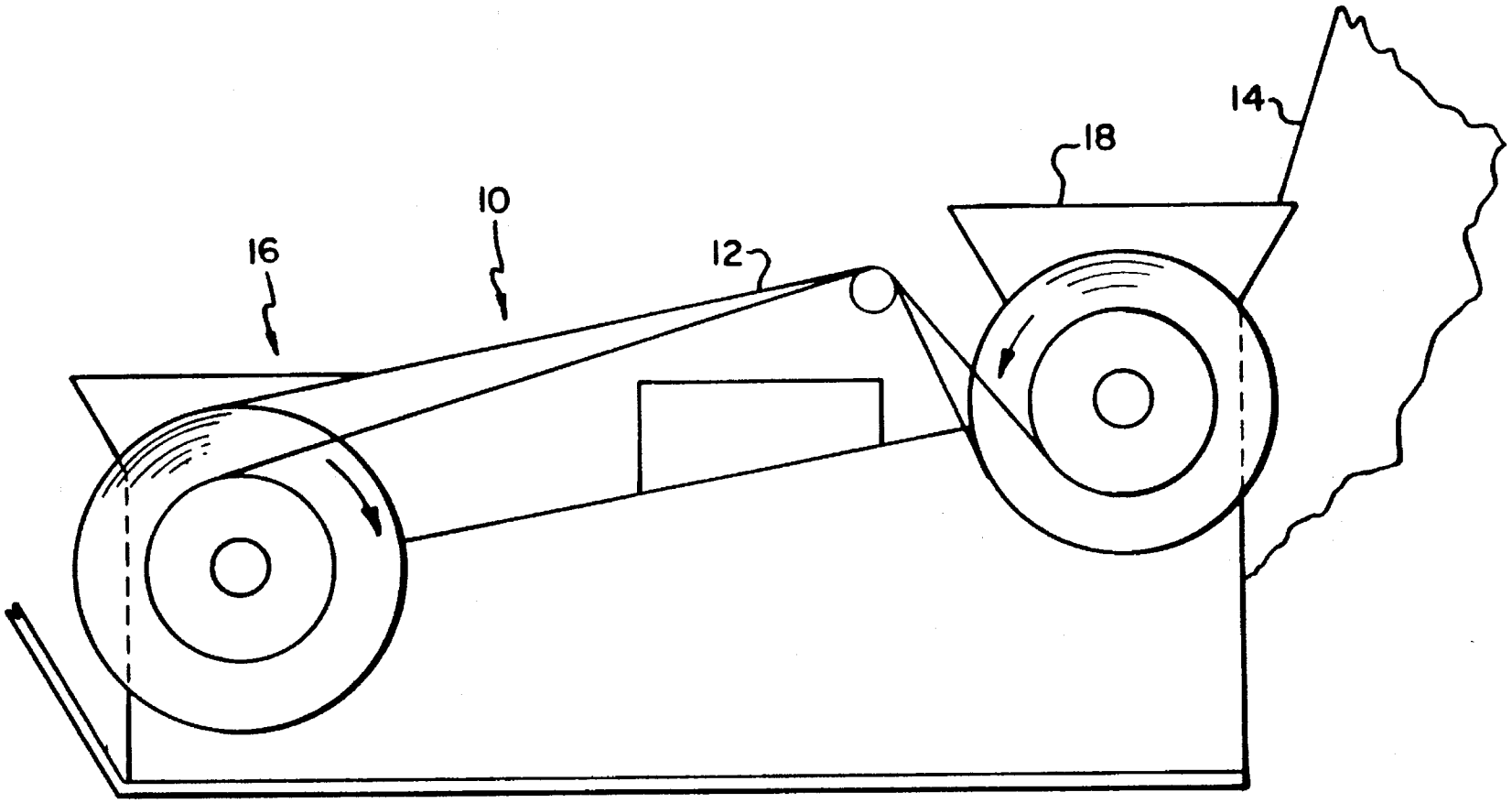
FIG. 1 is diagrammatical longitudinal sectional view of a preferred embodiment of a thermal printer with the cover open exposing dye donor web loading guide supports in accordance with the present invention.
Figure 2:
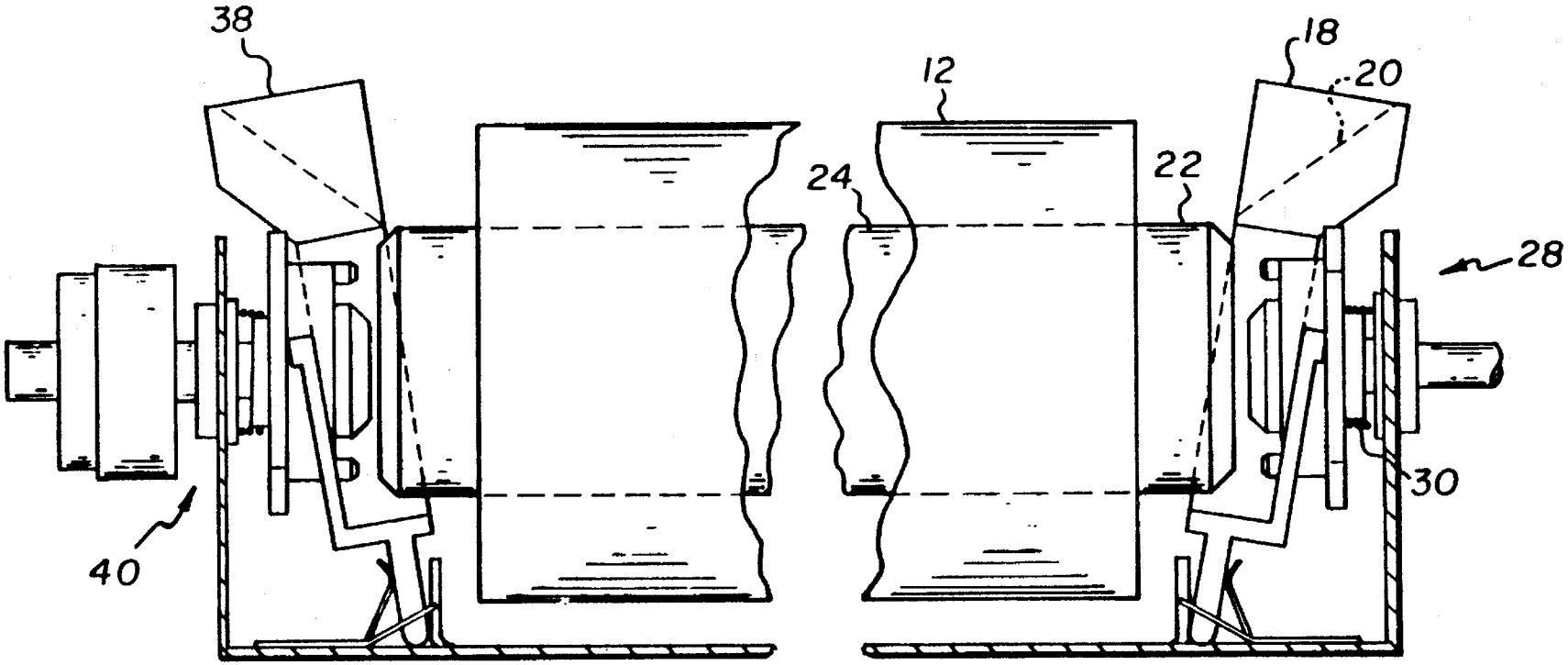
FIG. 2 is a somewhat enlarged, diagrammatic view of a spool being inserted into the receptacles of FIG. 1 with some parts shown in section and some parts cut away.
Figure 3:
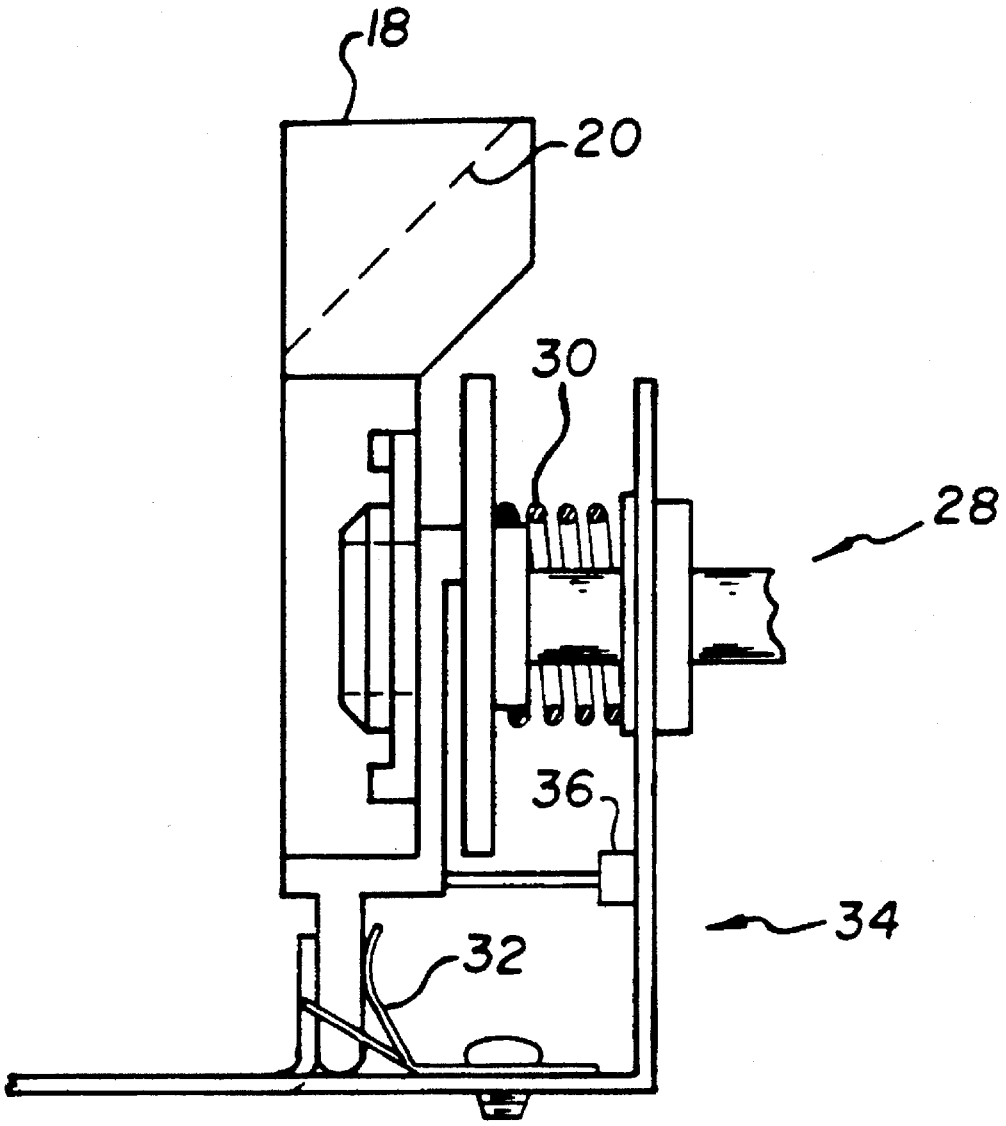
FIG. 3 is side view of a receptacle similar to the view shown in FIG. 2, but illustrating the guide support in the locked position.
Figure 4:
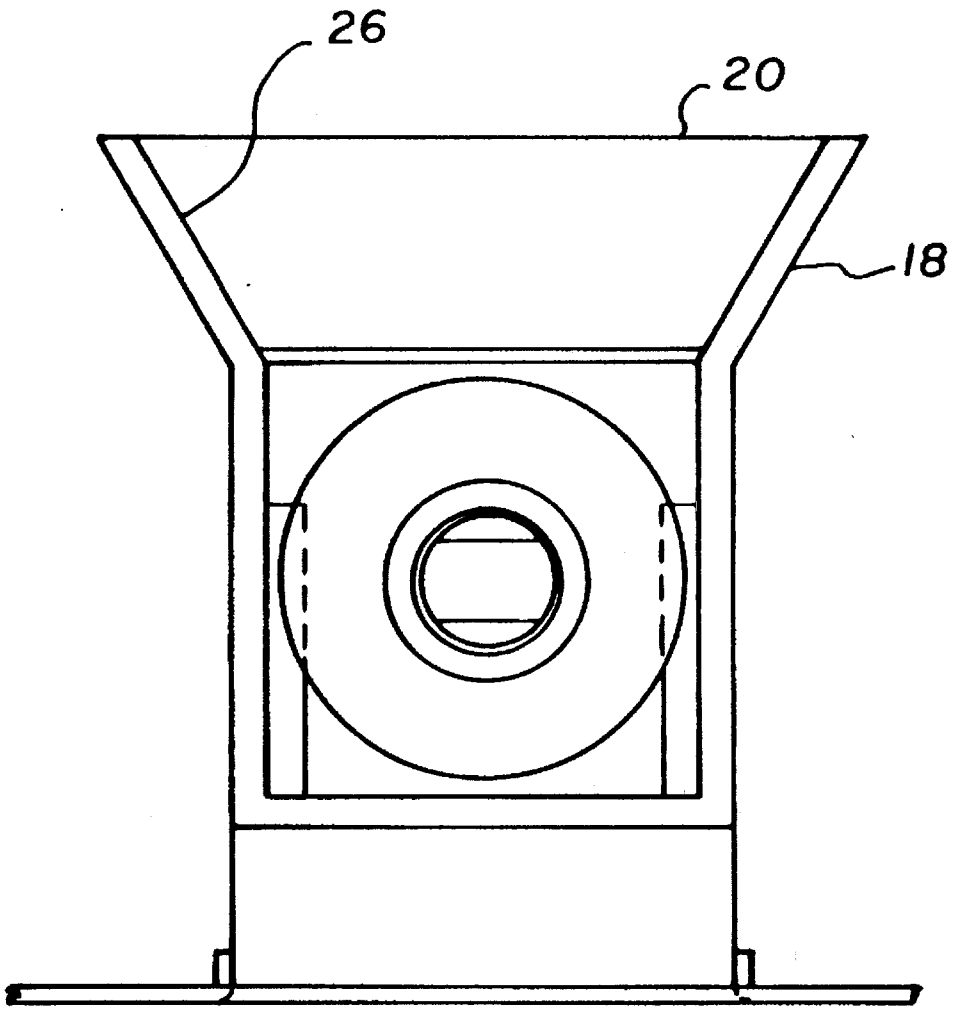
FIG. 4 is a left side view of the guide receptacle illustrated in FIG. 3.

Referring to FIGS. 1–2, a loading apparatus 10 for loading a dye donor web 12 into a thermal printer is illustrated. The printer has a base portion 14 and a door or cover portion 16 that is hingedly connected to the base portion 14 and movable between a closed position and an open position. At the closed position, the door 16 abuts the base 14, and, at the open position, the door 16 is swung away from the base 14 forming an angle greater than about 90 degrees. The door 16 swings an arc greater than 90 degrees in moving from the closed position to the open position to thereby provide easy access for inserting a new dye donor web and removing an expended dye donor web.

The dye donor web loading apparatus 10 includes a first guiding support mechanism or receptacle 18 attached to the door 16 and movable between a locked position and an unlocked position. The receptacle 18 has a slot 20 therein that is dimensioned to receive an end portion 22 of a dye donor web spool 24. The slot 20 has a tapered portion 26 for guiding an end portion 22 of the spool 24. Preferably, the end portion 22 of the spool 24 is also slightly tapered. The dye donor web loading apparatus 10 also includes a first means 18 for biasing the first receptacle 28 toward the locked position. The first means 28 preferably includes a coiled spring 30 in contact with the first receptacle 18 for biasing the first receptacle 18 towards the locked position.

Referring to FIGS. 1–4, the loading apparatus 10 includes a bracket 32 pivotally connected to the first receptacle 18 and fastened to the door 16 of the thermal printer. The bracket 32 engages the first receptacle 18 to thereby limit travel of the receptacle 18 towards the locked position.

The web loading apparatus 10 includes means 34 for detecting when the first guide receptacle 18 is in the locked position. The means 34 may include a microswitch 36 or other device to sense the position of the guide receptacle 18.

The dye donor web loading apparatus 10 includes a second receptacle 38 that is spaced from the first receptacle 18 and attached to the door 16. The second receptacle 38 is movable between a locked position and an unlocked and works in concert with first receptacle 18 to receive a dye donor web spool 24. As with the first receptacle 18, the second receptacle 38 is biased by a biasing means 40 toward the locked position.

Referring to FIGS. 1–5, just as the first and second receptacles 18, 38 form a pair of members and act concert to load the web 12, so do third and fourth receptacles 42, 44. The third and fourth members 42, 44 are constructed in a similar manner to the first and second receptacles 18, 38 and include biasing means, not shown but similar to coiled spring 30 of FIGS. 2 and 3. The first pair of receptacles 18, 38 receives supply spool 24a while the second pair of receptacles 42, 44 receives the take-up spool 24b so that the dye donor web 12 can be wound from supply spool 24a onto the take-up spool 24b as the web 12 traverses a path through the printer to effect thermal printing.

Figure 5:
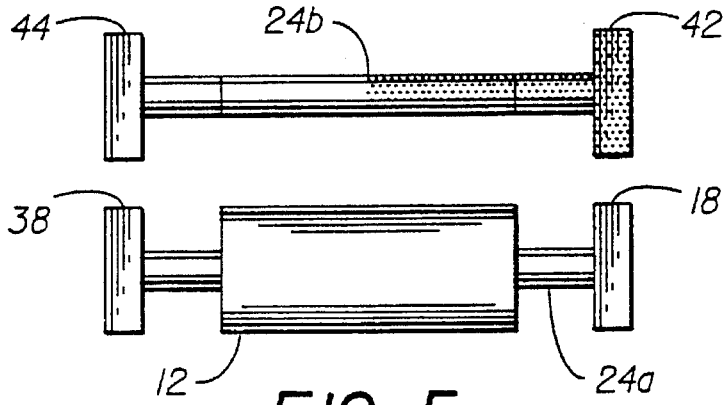
FIG. 5 is a diagrammatic view illustrating the alignment of supply and take-up spools.

Referring to FIG. 5, the take-up spool 24b is illustrated with a color coded end portion to match a color coded receptacle 42 or other color keyed or coordinated part of the thermal printer. The color code provides an easy visual identification for the operator to ensure correct insertion of the take-up spool without the need to read any instructions. As illustrated, the take-up spool 24b is symmetrical so that end for end swapping is not a concern, but color coding helps distinguish between the supply and take-up spools for operator convenience. The donor supply spool 24a may also be color coded or color coordinated, or have other indicia; however, a certain method for avoiding incorrect insertion is having the diameter of the supply spool 24a differ from the diameter of the take-up spool 24b so that the two spools cannot be interchanged.

As illustrated in FIG. 5, the diameter of the supply spool 24a is larger than the diameter of the take-up spool 24b which prevents the donor supply spool 24a from being inserted into the receptacle slots intended for the take-up spool 24b. While the smaller diameter take-up spool 24b fits into slots intended for the larger diameter supply spool 24a, there will be noticeable looseness to indicate that the spool is not correctly installed. Also, because both a supply spool and a take-up spool are required for operation, inserting the take-up spool 24b into the incorrect slots only results in the supply spool 24a not fitting in the remaining slots, which immediately indicates an error. Of course, the error can be quickly corrected by observing the color code.

Figure 6:
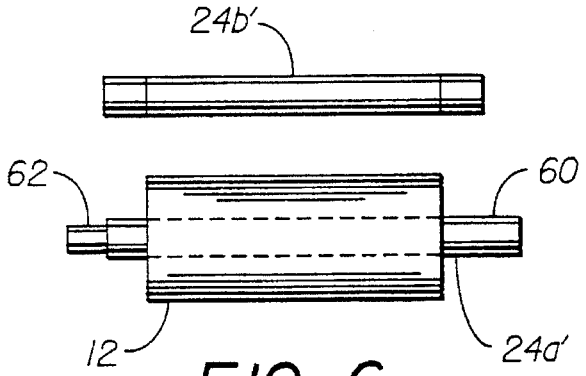
FIG. 6 is a diagrammatic view similar to FIG. 5, but illustrating another preferred embodiment wherein the diameter of each end of the supply spool is different for correct loading.

Referring to FIG. 6, the supply spool 24a' has a first end portion 60 to fit into the slot of the first receptacle, and a second end portion 62 to fit into the slot of the second receptacle. The first end portion 60 has a larger diameter than the second end portion 62, and the slots and the receptacles are designed to receive those respective diameters to prevent end for end swapping and incorrect loading. Thus, the large diameter of first end portion 60 is too large to fit into the slot for the second receptacle. The web 12 is centered on the spool 24a', and, while end for end swapping may not matter with regard to the donor path, it is desirable to have a certain end for end orientation to facilitate the use of coded dye donor web.

As illustrated, the large diameter continues through the body of the supply spool 24a' so that the dye donor web is wound about a large diameter body. Where it is desired to have a longer donor web without increasing space requirements, the diameter of the main body of the spool 24a' may be the smaller diameter. While it is preferred that the diameter of the spool 24a' in contact with web be uniform, it is not necessary to have a uniform diameter in contact with the web. It is sufficient that the web can be uniformly and smoothly wound onto the supply spool and removed from the supply spool.

Still referring to FIG. 6, swapping of the supply and take-up spools 24a', 24b' can be prevented by having one spool longer than the other spool. It is preferred, however, to have both spools the same length to simplify manufacturing operations.

Figure 7:
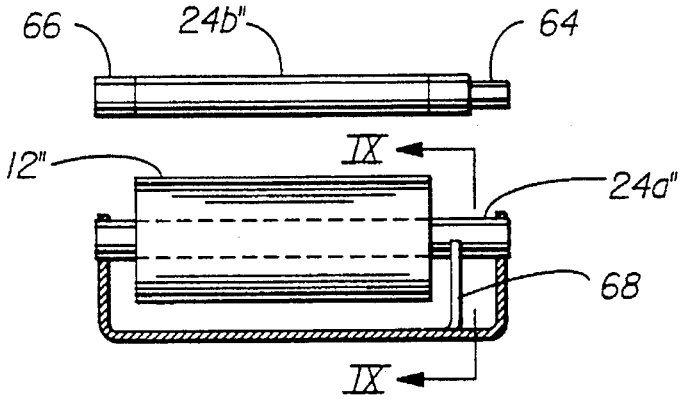
FIG. 7 is a diagrammatic view similar to FIGS. 5 and 6, but illustrating another preferred embodiment with an offset dye donor web and a mechanical stop for correct loading.
Figure 8A:
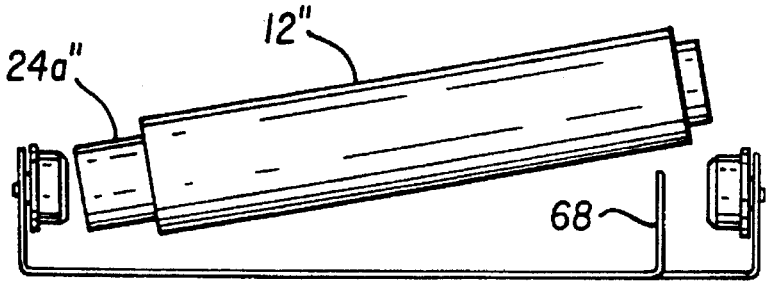
FIGS. 8a–8d illustrate four possible methods for loading the supply spool.
Figure 8B:
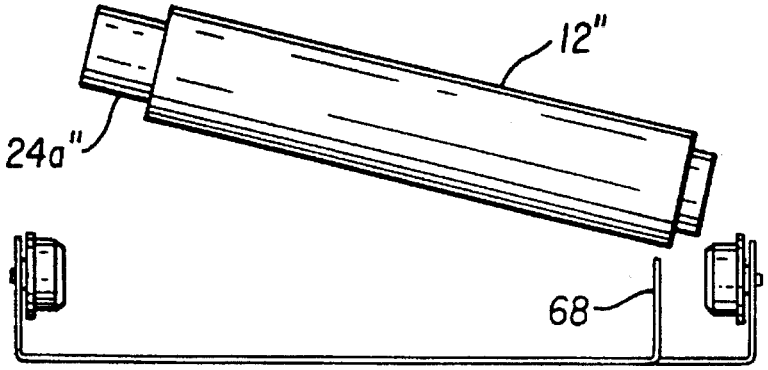
Figure 8C:
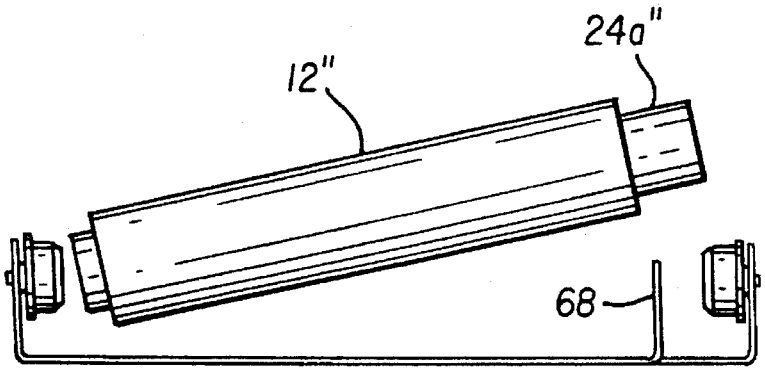
Figure 8D:
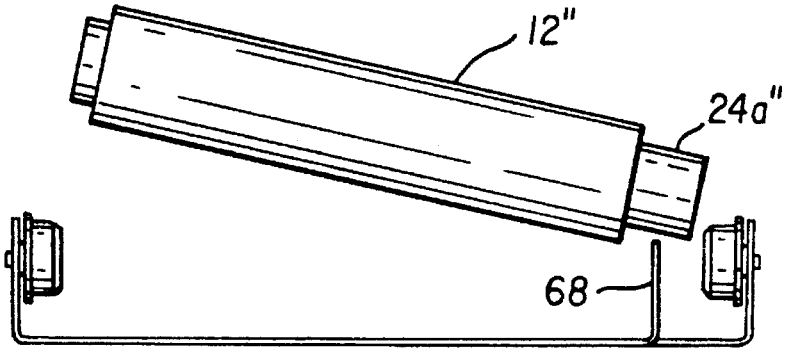

Referring to FIG. 7, the take-up spool 24b" can also have end portions of different diameters to mate with different diameters of the receptacles. The first end portion 64 of the take-up spool 24b" is smaller in diameter than the second end portion 66 of the take-up spool 24b". Alternatively, the first end portion 64 could be larger in diameter than the second end portion 66. This will also prevent incorrect end for end insertion of the take-up spool. It is preferred, however, that the diameter be uniform to facilitate construction by an extrusion process.

FIG. 7 also illustrates another method for preventing incorrect end for end insertion of the donor web supply spool 24*a*" in the case of a donor web 12" that is not centered on the supply spool 24*a*" but is displaced towards one end of the spool. To prevent incorrect end for end insertion of the supply spool 24*a*", a mechanical stop member 68 is used. The mechanical stop 68 will engage the web 12" on the spool 24*a*" if the spool is inserted incorrectly end for end and prevent the ends of the spool from locking into position in the slots in the guide receptacles.

The mechanical stop 68 may be a protrusion extending from the bracket 19 on which the receptacles are mounted. Alternatively, the mechanical stop could be a member attached to or mounted on the frame of the door or other member of the thermal printer. The stop is preferably part of the bracket 19, and formed thereon by a metal stamping process which cuts and then bends a portion of the bracket to form the upstanding protrusion. The stop may be a single member or multiple members may be formed (FIG. 9).

Figure 9:
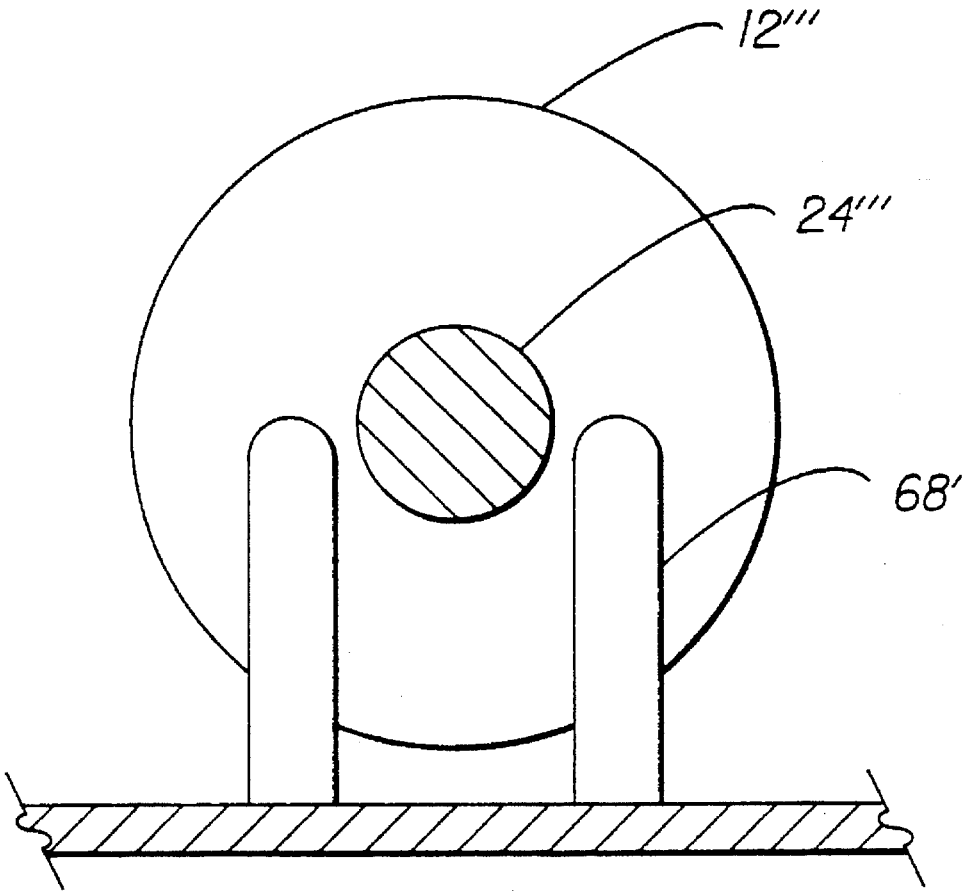
FIG. 9 is a diagrammatic sectional view taken along line IX—IX of FIG. 7, but illustrating another preferred embodiment.

Referring to FIGS. 7–9, an important aspect of the invention is the donor-printer interface when the supply spool is inserted onto the printer. This aspect features a dye donor web wound offset from the center of the supply spool so that the protrusion of one end portion of the spool from the web is more than the protrusion of the other end portion. A mechanical stop in the printer is positioned so that the longer end of the supply spool can pass the mechanical stop to mate with a spool receptacle. If the operator tries to insert the wrong end of the supply spool into the printer, the dye donor wound on the supply spool will engage the mechanical stop before the supply spool can seat properly (FIGS. 8*a* and 8*b*). This means that the supply spool can be installed in the printer in only one way thereby ensuring correct end for end orientation in the printer (FIGS. 8*c* and 8*d*). The mechanical stop could be a single element located near the supply spool location (FIG. 7), or a pair of symmetrically positioned elements straddling the supply spool location (FIG. 9). Also, the stop could be a dedicated element that only performs the mechanical stop function, or it could be a portion of some other printer element to perform the stop function as an auxiliary function.

Because space is normally at a premium in a thermal printer, the door will not close properly when the donor supply spool is not correctly seated. Without the proper door-base interface intact, certain electrical circuits are broken to prevent inadvertent electrical shock and unintentional operation of the printer. Thus, when the dye donor spool is not correctly inserted, dye donor is conserved when the unseated spool breaks the door-base thereby preventing operation of the printer. Because it is undesirable to operate the printer when there is zero probability of producing a print of acceptable quality, an incorrectly seated dye donor spool breaks the door-base interface and prevents the printer from printing. This process prevents valuable dye donor from being wasted.

As illustrated in FIG. 8, there are four possible ways to insert the dye donor spool with the web wound thereon. FIGS. 8*a*, 8*b* illustrate the incorrect loading method for the dye donor spool. While the protruding end of the spool can partially engage the receptacle in FIG. 8*a*, the short end of the spool will not be able to engage the other receptacle because the stop member will intercept the dye donor web to prevent the spool from being correctly seated. In FIG. 8*b*, when it is attempted to insert the shorter protruding end, the stop member immediately intercepts the web to prevent the spool from being inserted. Thus, as illustrated in FIGS. 8*a* and 8*b*, the spool cannot be inserted when the short end is oriented to the right where the stop member can intercept the web. On the other hand, FIGS. 8*c* and 8*d* show that the spool can be loaded when the longer protruding end of the spool is oriented to the right where it cooperates with the stop member.

Operation of the present invention is believed to be apparent from the foregoing description, but a few words will be added for emphasis. First, the door is opened past vertical to make the inside fully accessible. A new dye donor web is then installed by aligning one spool with the two slots that face each other in one guide assembly that face each other to receive the spool. The proper guide slots can be chosen by observing the indicia or color code, noting the alignment of the donor web on the spool, noting the length of the spools, or noting the diameters, whichever applies. Where colors or indicia are used, these are matched. Where spool lengths or diameters are different, only one spool will fit each pair of receptacles. And where the donor web is off center, the mechanical stop prevents incorrect end for end insertion. The aligned spool is pushed into the facing slots thereby causing the guide members to unlock and move against the biasing springs. As the spool is pushed farther, the guide members spring back locking the spool in position. The other spool is inserted into its guide members the same way. The tapered ends of the spools act as self-centering devices to aid the alignment. The tapered ends also aid in removal of a used spool which is removed by pulling it straight out of the slots. If desired, one receptacle may be pushed aside to assist removal, but pushing is not necessary.

It can now be appreciated that there has been described a dye donor web loading apparatus for a thermal printer to ensure correct loading of the supply and take-up spools and prevent incorrect loading of the dye donor supply spool. Loading is correct with respect to the supply and take-up spools being in the proper receptacles, and with respect to each spool being correctly oriented in its receptacles. The first and second receptacles 18, 38 may be conveniently spaced from one another a different distance than the third and fourth receptacles 42, 44 to accommodate supply and take-up spools of different lengths. Having the supply spool 24*a* longer or shorter than the take-up spool 24*b* prevents incorrect insertion of the spools caused by swapping the spools. Having different lengths also allows the web 14 to be centered on one spool but not the other to prevent swapping and incorrect insertion in the thermal printer. The receptacles 18, 38, 42, 44 may be color coded along with the ends of the spools to give a visual indication of correct insertion orientation. The slots in the first and second receptacles may have dimensions different from the slots in the third and fourth receptacles to receive spools of different diameters or cross section. This construction prevents swapping of the supply and take-up spools. Also, each slot in a pair of slots may have different diameters or cross-sections to prevent end for end swapping of a spool and incorrect loading. The slots may have tapered portions to aid in inserting the spools.

While the invention has been described with particular reference to the preferred embodiments, it will be understood by those skilled in the art that various changes may be made and equivalents may be substituted for elements of the preferred embodiment without departing from the invention. For example, the mechanical stop could be formed on the supply spool to cooperate with the receptacle bracket or the door to prevent improper loading. In addition, many modifications may be made to adapt a particular situation and material to a teaching of the invention without departing from the essential teachings of the present invention.

The present invention provides a cartridge free dye donor loading system that is simple to use and that prevents incorrect insertion of the spools. An operator cannot insert the spools incorrectly. It also provides simple access to the spools for easy insertion and removal. The mechanical stop always ensures correct insertion of the supply spool with an off-center dye donor web.

It can now be appreciated that there has been presented a thermal printer with a mechanism for preventing incorrect loading of the donor web supply and take-up spools. The thermal printer has a dye donor supply spool with a body and first and second end portions extending from the body. First and second receptacles are positioned for matingly receiving the first and second end portions, respectively, of the dye donor supply spool. A dye donor take-up spool has a body and a first and second end portions extending from the body. Third and fourth receptacles are positioned for matingly receiving the first and second end portions, respectively, of the dye donor take-up spool. The supply spool is correctly loaded only when the first and second end portions of the supply spool matingly engage the first and second receptacles, respectively, and the take-up spool is correctly loaded only when the first and second end portions of the take-up spool matingly engage the third and fourth receptacles, respectively. Mechanical means are provided for preventing incorrect loading of the supply and take-up spools.

A mechanical stop prevents incorrect end for end loading of a supply spool that has an off center web wound thereon by engaging the web and preventing the end of the spool from engaging the receptacle. The cover cannot close without properly mounted spools. Electrical circuits are opened when the cover is opened preventing the printer from operating. Thus, printer operation is possible only when the spools are properly loaded.

As is evident from the foregoing description, certain aspects of the invention are not limited to the particular details of the examples illustrated, and it is therefore contemplated that other modifications and applications will occur to those skilled the art. For example, while moveable guide supports are illustrated, the incorrect insertion features of the present invention works equally well with other spool receiving mechanisms. There is no desire or need to operate the printer where there is a very low probability that a print of acceptable quality can be achieved; so, an incorrectly seated spool breaks the cover-base interface to prevent printing. It is accordingly intended that the claims shall cover all such modifications and applications as do not depart from the true spirit and scope of the invention.

What is claimed is:

1. Thermal printer apparatus comprising:

a supply spool having opposed cylindrical ends of substantially the same diameter and shape;

a pair of spaced, rotatable, axially aligned spindles adapted to receive a respective one of said opposed ends of said supply spool, there being a correct end-for-end orientation of said supply spool and an incorrect end-for-end orientation of said supply spool on the spindles;

a mechanical stop member in the space between said spindles and closer to one of the spindles than the other; and a dye donor web wound on said supply spool to form a cylindrical roll which is axially shorter than said spool and axially off center of said spool so as to leave a substantially longer portion of the spool extending beyond one end of the roll than extends beyond the other end of the roll, whereby the roll will interfere with the mechanical stop member of a thermal printer of the type described when an attempt is made to insert the apparatus incorrectly in such a thermal printer, but will not interfere with the mechanical stop member of a thermal printer of the type described when an attempt is made to insert the apparatus correctly in such a thermal printer.

2. Apparatus for use with a thermal printer of the type having (i) a pair of spaced, rotatable, axially aligned spindles and (ii) a mechanical stop member in the space between the spindles and closer to one of the spindles than the other, said apparatus comprising:

a supply spool having opposed cylindrical ends of substantially the same diameter and shape, each of said ends being adapted to receive a respective one of the spindles of a thermal printer of the type described, there being a correct end-for-end orientation of said supply spool in such a thermal printer and an incorrect end-for-end orientation of said supply spool in such a thermal printer, and a dye donor web wound on said supply spool to form a cylindrical roll which is axially shorter than said spool and axially off center of said spool so as to leave a substantially longer portion of the spool extending beyond one end of the roll than extends beyond the other end of the roll, whereby the roll will interfere with the mechanical stop member of a thermal printer of the type described when an attempt is made to insert the apparatus incorrectly in such a thermal printer, but will not interfere with the mechanical stop member of a thermal printer of the type described when an attempt is made to insert the apparatus correctly in such a thermal printer.

3. Apparatus as set forth in claim 2 wherein said supply spool has a cylindrical cross-sectional shape.

* * * * *